US006321676B1

(12) United States Patent
Kohnen et al.

(10) Patent No.: US 6,321,676 B1
(45) Date of Patent: Nov. 27, 2001

(54) UNDERWATER CRAFT HAVING SEALED AND INFLATABLE BUOYANCY CHAMBERS

(75) Inventors: William Kohnen; Ian Sheard, both of Claremont, CA (US)

(73) Assignee: Seamagine Hydrospace Corporation, Claremont, CA (US)

( * ) Notice: Subject to any disclaimer, the term of this patent is extended or adjusted under 35 U.S.C. 154(b) by 0 days.

(21) Appl. No.: 09/478,581

(22) Filed: Jan. 6, 2000

Related U.S. Application Data

(60) Provisional application No. 60/115,019, filed on Jan. 7, 1999.

(51) Int. Cl.[7] ..... B63G 8/00
(52) U.S. Cl. ..... 114/312; 114/331
(58) Field of Search ..... 114/173, 312, 114/314, 313, 335, 331; 277/914

(56) References Cited

U.S. PATENT DOCUMENTS

| | | | | |
|---|---|---|---|---|
| 1,579,109 | * | 3/1926 | Haseley | 114/331 |
| 1,864,471 | * | 6/1932 | Rademacher | 114/335 |
| 3,257,982 | * | 6/1966 | Meldrum | 114/331 |
| 3,403,915 | * | 10/1968 | Roberts | 277/914 |
| 3,452,696 | * | 7/1969 | Moreland | 114/335 |
| 3,520,263 | * | 7/1970 | Berry et al. | 114/331 |
| 3,713,412 | * | 1/1973 | Ianuzzi | 114/312 |
| 3,987,742 | * | 10/1976 | Boisrayon et al. | 114/335 |
| 4,577,583 | | 3/1986 | Green, II . | |
| 4,721,055 | | 1/1988 | Pado . | |
| 4,938,164 | | 7/1990 | Onofri . | |
| 5,704,309 | | 1/1998 | Kohnen . | |

* cited by examiner

*Primary Examiner*—Stephen Avila
(74) *Attorney, Agent, or Firm*—Baker & McKenzie

(57) ABSTRACT

An underwater craft having a buoyancy control system, multi-sealed passenger chamber and emergency shut-off for external operation using inherent buoyancy of the craft.

21 Claims, 6 Drawing Sheets

UNDERWATER CRAFT HAVING SEALED AND INFLATABLE BUOYANCY CHAMBERS

CROSS REFERENCE TO RELATED APPLICATION

This application claims priority of U.S. Provisional Patent Application No. 06/115,019, filed Jan. 7, 1999, now expired.

FIELD OF THE INVENTION

The present invention relates to an underwater craft for recreational touring in an aquatic environment.

BACKGROUND OF THE INVENTION

Various forms of underwater craft are known. The known craft utilize various forms of ballast techniques and apparatus in order to adjust buoyancy, various forms of operator and passenger compartments various forms of stabilization systems. One such underwater craft is described in commonly assigned U.S. Pat. No. 5,704,309 and others examples are found in U.S. Pat. Nos. 4,577,583, 4,721,055 and 4,938,164.

It is also known to provide compartments where passengers, operators or live cargo are situated, and various forms of hatches and sealing devices for preventing water intrusion are used. For example, one form of hatch and sealing structure uses a rotatable knob and hingedly operated hatch of entry and exit from a compartment. In typical sealing structures, multiple latching points are used. A typical seal is an O-ring seal. One deficiency of the known hatches and sealing devices is complexity of manufacture and components.

A further disadvantage is the complexity of known sealing structures. It is understood that pressure increases as the distance below the surface of a body of water increases. A disadvantage of known seals is that a single sealing system is used to accomplish low and high pressure sealing. In such known sealing systems, a seal is created which is effective at both low pressure depths and high pressure depths, making it necessary to provide additional latching apparatus to provide sufficient localized sealing pressures at low pressure depths. At low pressures, known high pressure seals, such as O-ring seals, force the sealing surfaces to separate between the latching and hinge points, compromising the functionality of the seal. Multiple latch points have been used in such seals, although they suffer the disadvantage of increased manufacturing complexity, increased maintenance difficulty and increased operational complexity.

There also is a need to provide stability and buoyancy of an underwater craft at the surface, such as while loading and unloading passengers. The underwater craft described in U.S. Pat. No. 5,704,309 describes a surface buoyancy system having buoyancy chambers that can be filled with water to decrease buoyancy such as when submerging or that can be evacuated to increase buoyancy and stability at the surface. A disadvantage is that the buoyancy chambers increase the cross-sectional area of the craft.

There also are various forms of operator stations for underwater craft. A typical operator station is located in the same compartment as the passenger or cargo compartment or in a subcompartment of the passenger or cargo compartment. A disadvantage of the known operator compartments is that passengers share the same space as the operator. Another disadvantage is that the operator cannot travel outside the vehicle or in a separated compartment from the passengers. A further disadvantage is that the passengers have diminished privacy.

It is therefore an object of the present invention to provide a passenger or cargo entry and sealing system that provides increased manufacturing efficiency and a seal against water intrusion.

Another object of the present invention is to provide a surface buoyancy supplementing system that has a reduced cross-sectional area for underwater operation but also provides stability and buoyancy for loading and unloading passengers.

Yet another object of the present invention is to provide a passenger compartment that is separated from an operator's station and provides increased privacy for passengers.

A further object of the present invention is to provide an operator's station outside the vehicle.

SUMMARY OF THE INVENTION

The present invention alleviates to a great extent the disadvantages of the known underwater craft by providing an underwater craft which provides supplemental surface stabilization using expandable buoyancy chambers, such as for loading or unloading the craft or operating at the surface, a sealable passenger or cargo chamber also providing buoyancy for the vehicle, and an external operator station preferably separated from the sealable passenger or cargo chamber and which optionally is enclosed in a sealed chamber contributing to the buoyancy of the craft.

Any form of buoyancy control system may be provided as long as the vehicle can be submerged when desired. A vertical thrust system may be provided, countering the upward buoyancy of the craft, thereby enabling the craft to submerge. In order to raise the craft, such as from a submerged position to a surfaced position, the downward thrust is reduced to a level that is insufficient to counter the positive buoyancy of the craft. The craft can include a vertical thruster cut-off system which can be activated when a passenger or operator at the external station leaves the craft, either purposefully or by accident, causing the positive buoyancy of the craft to cause it to rise to the surface.

The chambers in the craft can be sealed using a dual or multi-seal system. In the sealing system, annular seals for operation at varying pressure are provided. It is preferred that the outermost seal be the lowest pressure seal, although other arrangements may be provided. With respect to the passenger chamber, the chamber preferably is a generally clear sphere separated into an upper canopy portion and a lower portion mounted to the structure of the craft. A two point attachment system is used to attach the canopy to the lower mounted portion. This includes a rotation enabling mechanism, such as a hinge or any other suitable rotating connector. Also included is a releasable latching mechanism.

The buoyancy control system also optionally includes a supplemental buoyancy system. These can include inflatable soft chambers, which when inflated supplement the buoyancy of the craft. No ballast water must be carried with the vessel when submerged, minimizing the underwater mass of the vessel and promoting maneuverability.

Each of the above-described features of the present invention can be combined with each other in any fashion, including combining each of the features together in a single watercraft. The above and other objects and advantages of the invention will be apparent upon consideration of the following detailed description, taken in conjunction with the accompanying drawings in which like reference characters refer to like parts throughout.

DETAILED DESCRIPTION OF THE INVENTION

Figure 1:
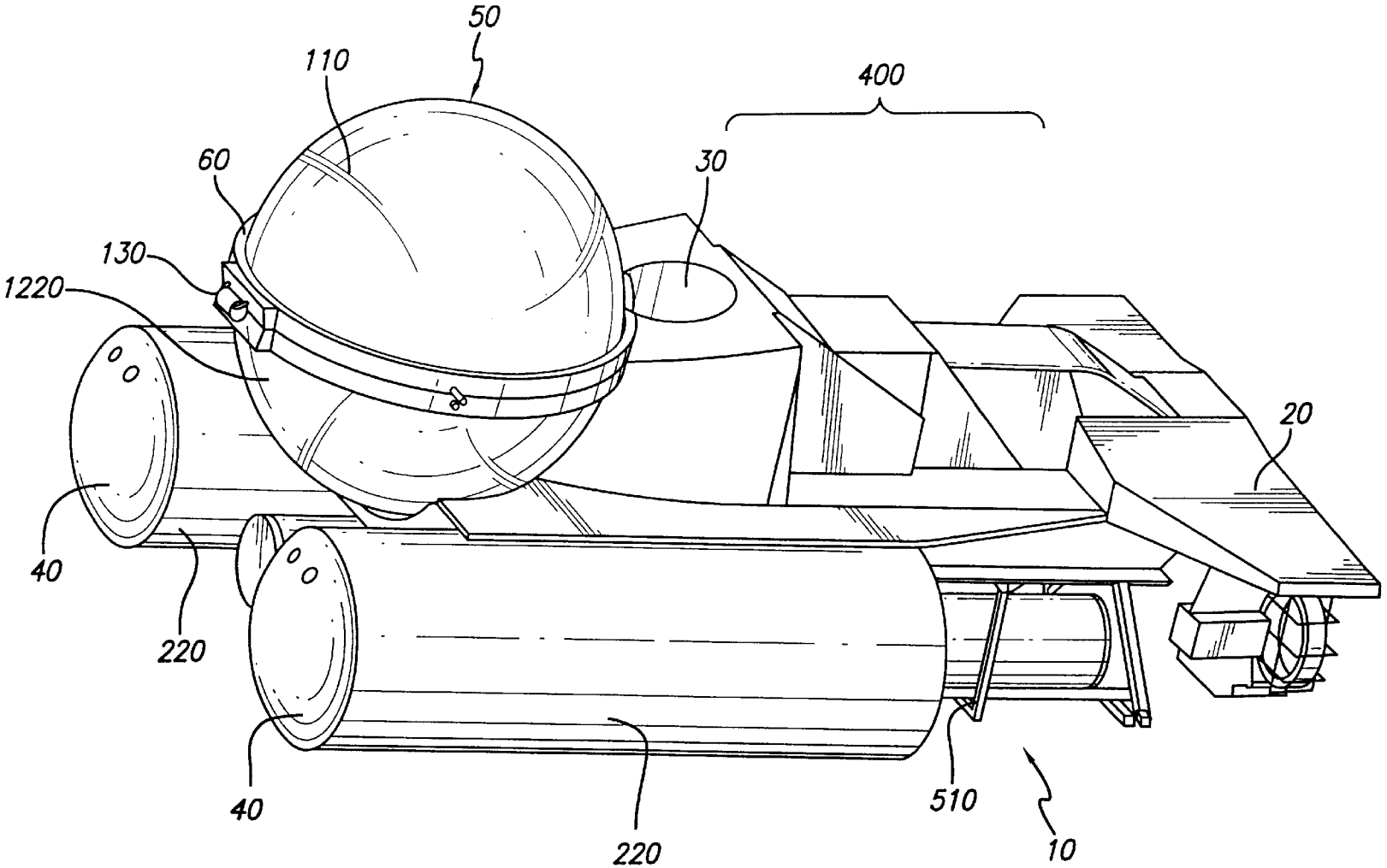
FIG. 1 is a front-side perspective view of a watercraft in accordance with the present invention.
Figure 3:
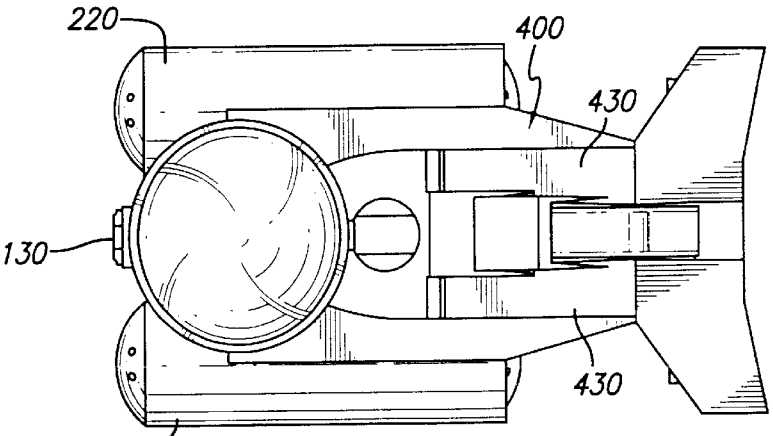
FIG. 3 is a top view of a watercraft in accordance with the present invention.
Figure 4:
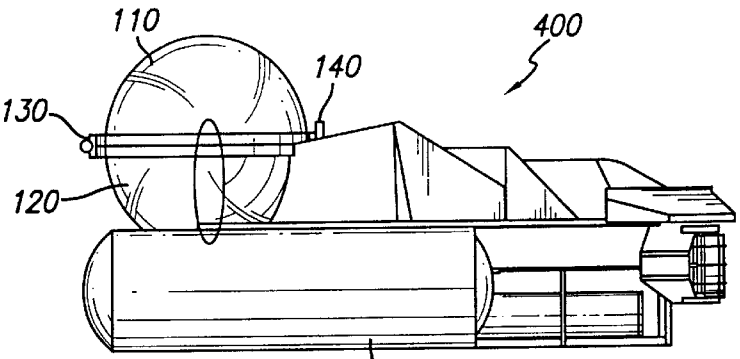
FIG. 4 is a side view of a watercraft in accordance with the present invention.
Figure 2:
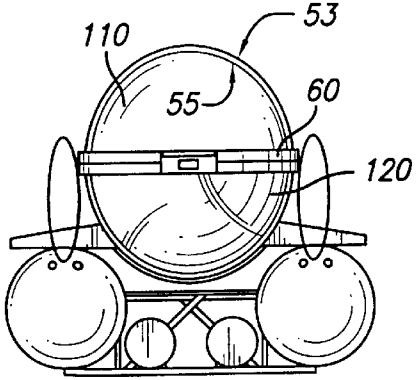
FIG. 2 is a front view of a watercraft in accordance with the present invention.

FIG. 1 provides a perspective view of an underwater craft in accordance with the present invention. Any shape or size of underwater craft may be used. The underwater craft includes a structure 10 supporting various components, including a tail section 20, thruster system 30, a buoyancy control system, including supplemental buoyancy chambers 40 and passenger chamber 50.

An example of a buoyancy control system for suitable use with the underwater craft of the present invention is described in co-pending, commonly assigned U.S. Pat. No. 5,704,309 which is referred to and incorporated herein by this reference. In this exemplary embodiment, the underwater craft has a positive buoyancy when in use. This means that in the absence of a mechanically provided downward thrust, the underwater craft floats to the surface. The buoyancy is provided by a buoyancy control system comprising a plurality of buoyancy providing elements. It should be understood that any other suitable buoyancy control system may also be used which can provide for lowering and increasing the depth of the underwater craft.

The passenger chamber 50 is a sealed chamber preferably being made of a clear material to allow passengers within the chamber 50 to have a wide field of view. For example in the preferred embodiment the ceiling is clear, as well as the forward and side walls of the chamber 50, providing for a wide field of view. Although the chamber 50 is referred to as a passenger chamber, it should be understood that it also is suited for carrying any other items such as cargo, equipment such as supplies, plants or other living beings (all will be collectively referred to herein as "passengers").

Any generally water impermeable structure may be used for the passenger chamber 50. Preferably, passenger chamber 50 includes a structure which is filled with air or other gaseous fluid, which has a lower density than water. In a preferred embodiment, the passenger chamber 50 may include a cockpit providing a suitable atmosphere for humans, although in other embodiments, the underwater craft is operated without human occupants.

The size of the chamber 50 depends on the use desired. In general, the greater the amount of buoyancy desired, or the greater number of passengers desired, the greater the volume of chamber 50 required. For example the volume of chamber 50 may be adjusted by adjusting its internal dimensions, such as a diameter. Alternatively, the buoyancy of the chamber 50 may be adjusted by adjusting the thickness of the surfaces of the chamber 50, as measured from the outer surface 53 to the corresponding inner surface 55. Likewise the buoyancy of the chamber may be adjusted by using heavier or lighter materials. For example, a chamber 50 constructed of plastic or other polymeric material generally will provide greater buoyancy than a chamber 50 having the same volume and thickness, but constructed of a denser material, such as steel. In a preferred embodiment a clear plastic material is used. Any shape of chamber 50 may also be used, such as a tube with rounded ends, an oblong tube, or a sphere as depicted in FIG. 1.

In operation, the passenger chamber 50 is sealed from water intrusion using sealing system 60, creating an internal environment preferably containing breathable air for passengers and an external environment, namely the body of water into which the underwater craft travels, or alternatively, when at the surface, the ambient environment including air, mist and/or spray. The passenger chamber 50 also provides buoyancy while submerged, as the internal environment containing air is generally less dense than the aquatic external environment. In conjunction with the exemplary buoyancy control system described in commonly assigned U.S. Pat. No. 5,704,309, the passenger chamber 50 serves as a front buoyancy chamber.

The sealing system 60 provides a hinged aperture for gaining access to the interior of the chamber 50. As illustrated in the figures, the chamber 50 has hingedly connected sections, which when closed are sealed with the sealing system. A first section 110 is hingedly connected to a second section 120 using hinge 130. The first and second sections 110, 120 may be of any size as long as a sufficiently sized access aperture is provided for the size of passenger or cargo desired. In a preferred embodiment, the first section 110 includes the upper canopy of a vertically opening spherically shaped passenger compartment 50. In this preferred embodiment, the second section 120 is the lower portion of the spherical compartment 50 and preferably is fixedly mounted to the craft structure 10 and does not rotate with respect to the craft structure 10. The first section 110 in this embodiment preferably is a generally clear partial sphere, providing easy access to the interior of the chamber 50 for passengers as well as providing a wide viewing field, such as 180° for passengers situated within the interior of the underwater craft. In the illustrated embodiments, the first section 110 is a half sphere, representing the upper 180° of the sphere and the second section 120 is the lower half sphere representing the 180° of the sphere. It should be understood that any portion of the sphere may be used for either the first or second sections 110, 120 as long as an access opening of sufficient size for the desired use of the underwater craft is provided. For example, to reduce the size and weight of the first section 110, its size may be reduced, such as to occupy a smaller portion of the passenger chamber 50. For example, the first section 110 may occupy the top 90° of the sphere, forming a hinged hatch for access to the interior of the chamber 50.

In operation in this preferred embodiment, the first section 110 rotates about hinge 130 in order to open the passenger chamber 50. In closing the passenger chamber 110, the first section 110 mates with the second section 120 using sealing system 60 and they are held together with a latching mechanism 140.

Figure 8:
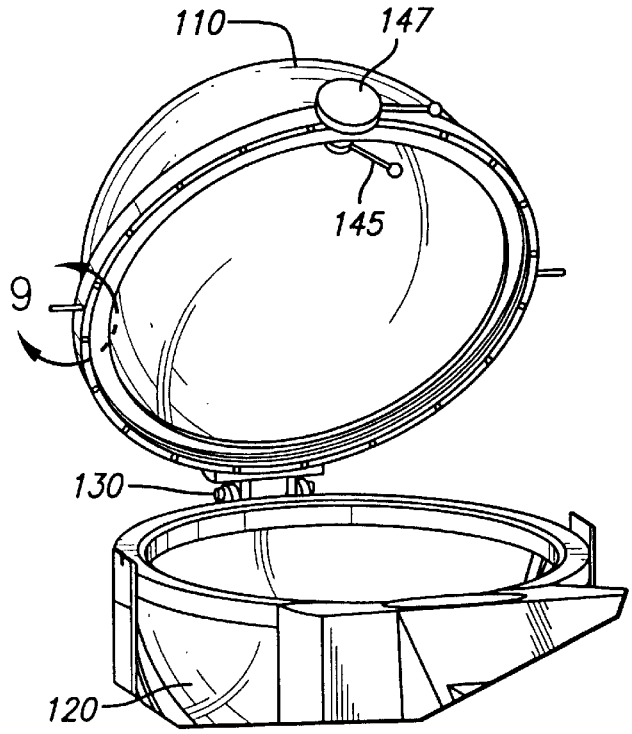
FIG. 8 is a detail view of a sealing mechanism of a watercraft in accordance with the present invention.
Figure 9:
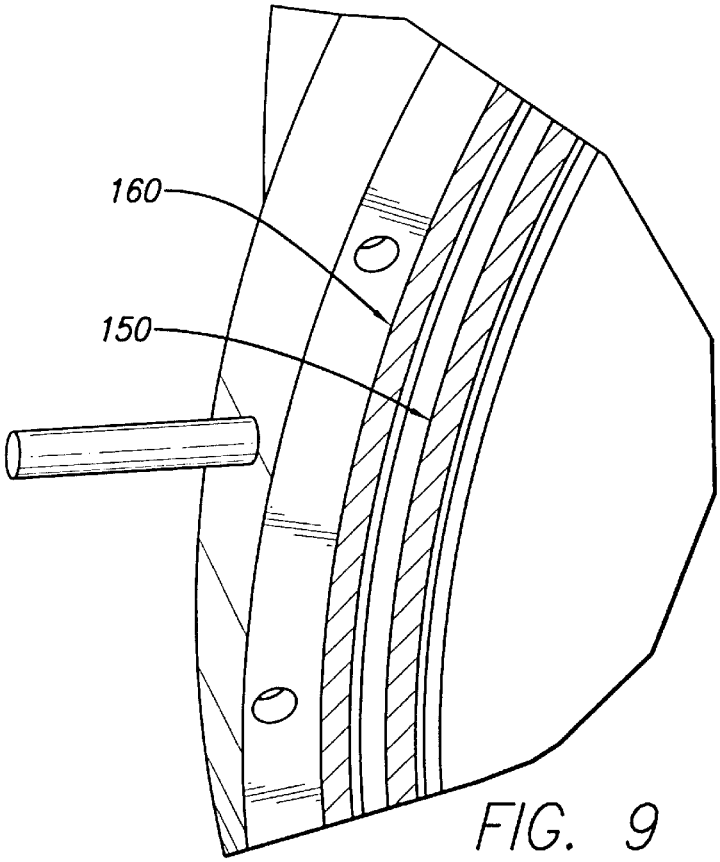
FIG. 9 is a sectional view of a sealing mechanism taken from circle A—A in FIG. 9 of a watercraft in accordance with the present invention.
Figure 10:
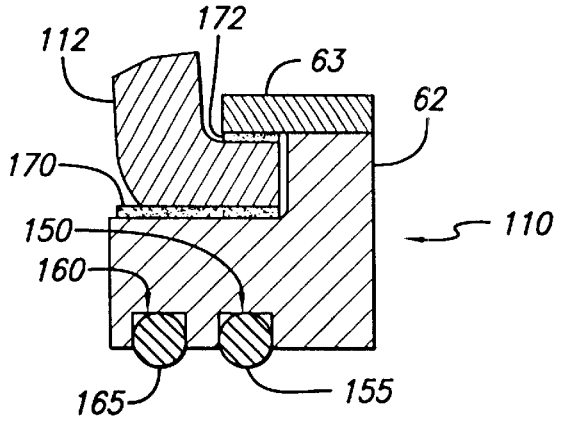
FIG. 10 is a cross-section of a portion of a sealing mechanism of a watercraft in accordance with the present invention.
Figure 11:
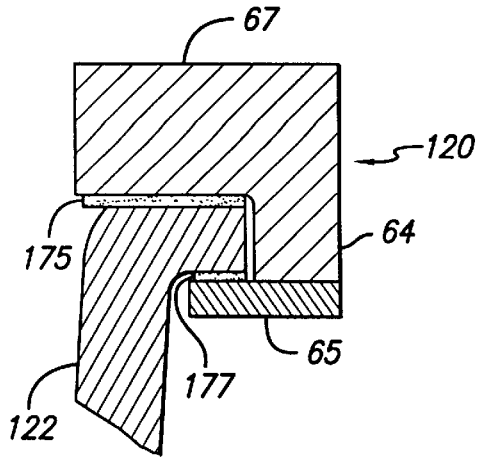
FIG. 11 is a cross-section of a portion of a sealing mechanism of a watercraft in accordance with the present invention.
Figure 13:
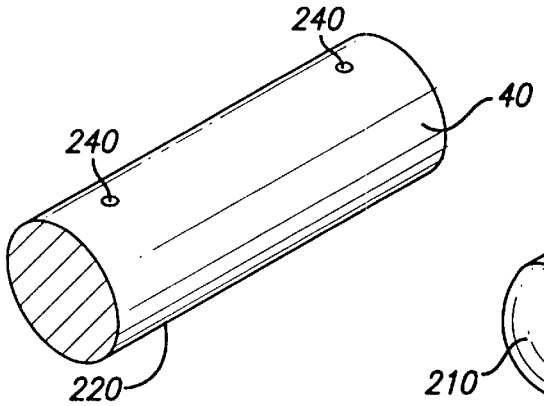
FIG. 13 is a side view of an uninflated buoyancy chamber in accordance with the present invention.
Figure 14:
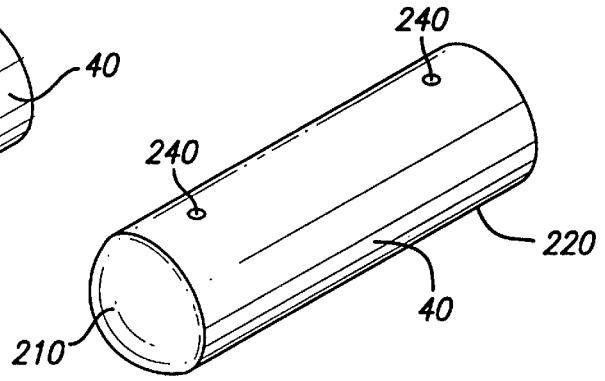
FIG. 14 is a side view of an inflated buoyancy chamber in accordance with the present invention.
Figure 15:
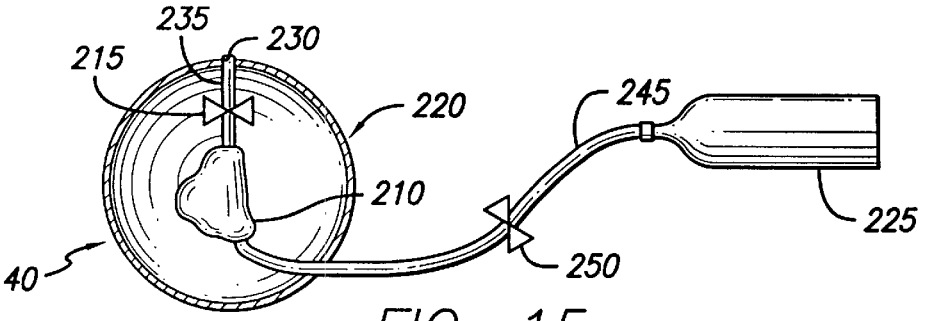
FIG. 15 is a front view of an uninflated buoyancy chamber with attached inflation system in accordance with the present invention.
Figure 12:
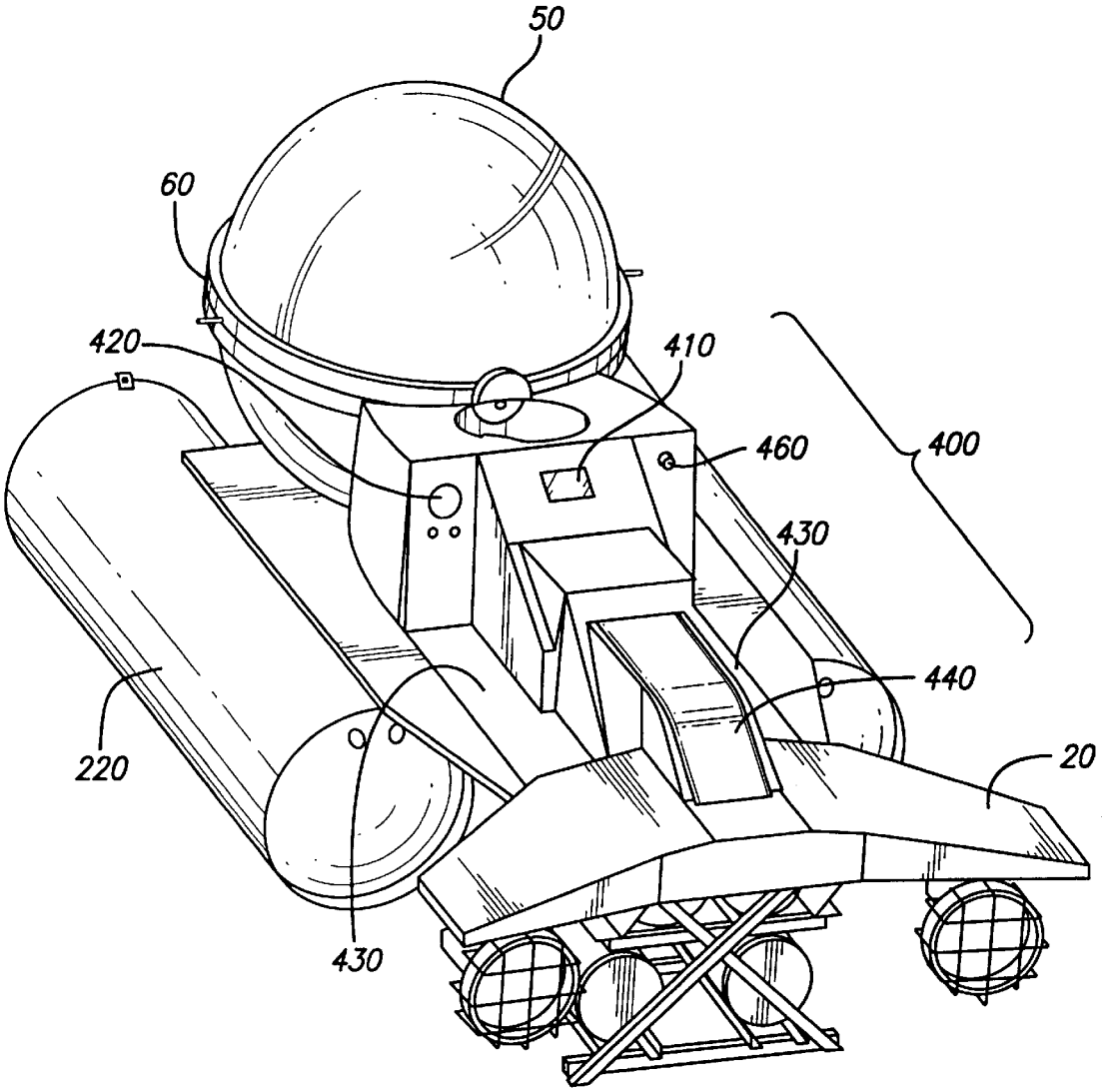
FIG. 12 is a rear perspective view of a top view of a watercraft in accordance with the present invention.

Any form of latching mechanism may be used as long as it can serve to hold together the first and second sections 110, 120 when latched. In one embodiment, the latch 140 includes a hook (not shown) in one of the first or second sections 110, 120 which engages a receiving assembly in the other of the sections. In this example, a handle 145 may be operated to engage the hook with the receiving assembly. Alternatively, an electronically controlled mechanism may be used. In yet another alternative embodiment, a magnetic latch is used in which magnetic attraction is used. Preferably the latching mechanism 140 includes an interior operation member 145 on the interior of the passenger chamber 60, and an exterior operation member 147 on the exterior of the passenger chamber 60, as illustrated in FIG. 8. Any form of operation members may be used as long as they can activate the latching mechanism 140 to unlatch as desired. The internal operation member 145 is operable from the interior of the passenger chamber 60. For example, a passenger inside the chamber 60 may operate the latching mechanism 140 using internal operation member 145, such as to close or open the latch. In the illustrated embodiment, the internal operation member 145 includes a rotatable handle for operating the latch. Alternative internal operation members 145 may include knobs, buttons, electrical switches or any other suitable member. The external operation member 147 is operable from the exterior of the passenger chamber 60. For example, a diver or operator outside the chamber 60 may operate the latching mechanism 140 using the external operation member 147, such as to close or open the latch. In the illustrated embodiment, the external operation member 145 includes a rotatable knob for operating the latch. Alternative external operation members 145 may include knobs, buttons, electrical switches or any other suitable member for operation of the latch. It is preferred to include both internal and external operation members in the craft to enhance safety and flexibility of operation. An alternative latching system 145 is digitally controlled and operated. Yet another alternative is a remotely operated latching system 145, such as using wireless signals to lock and unlock the latching system 145. For example, RF, microwave or induction operated systems may be used.

An embodiment of the sealing system 60 is illustrated in greater detail in FIGS. 6 through 12. In the preferred, illustrated embodiment a two point hinge and latch system is used, in which the latching system 145 is situated at the opposite side of the chamber 50 from the hinge 130. The latching system may be located at any point sufficient to provide secure latching of the sealing system 60, although a location 180° from the hinge 130 is preferred. Alternatively plural latches may be used at various points in the sealing system.

Figure 6:
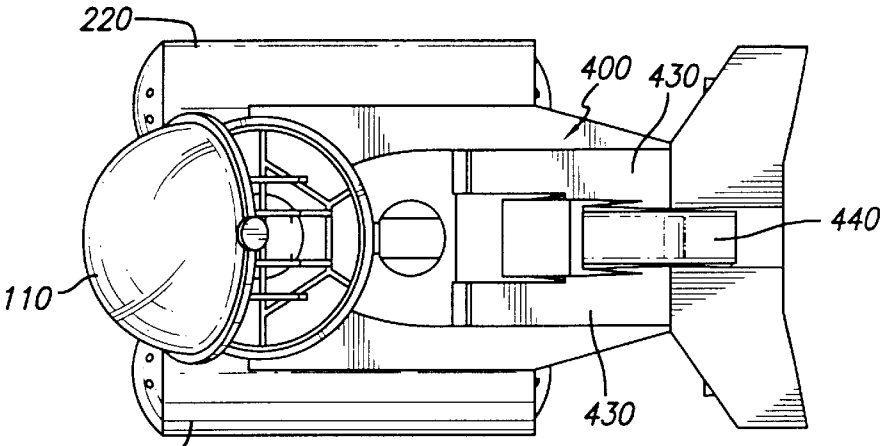
FIG. 6 is a top view of a watercraft having an open passenger chamber in accordance with the present invention.
Figure 7:
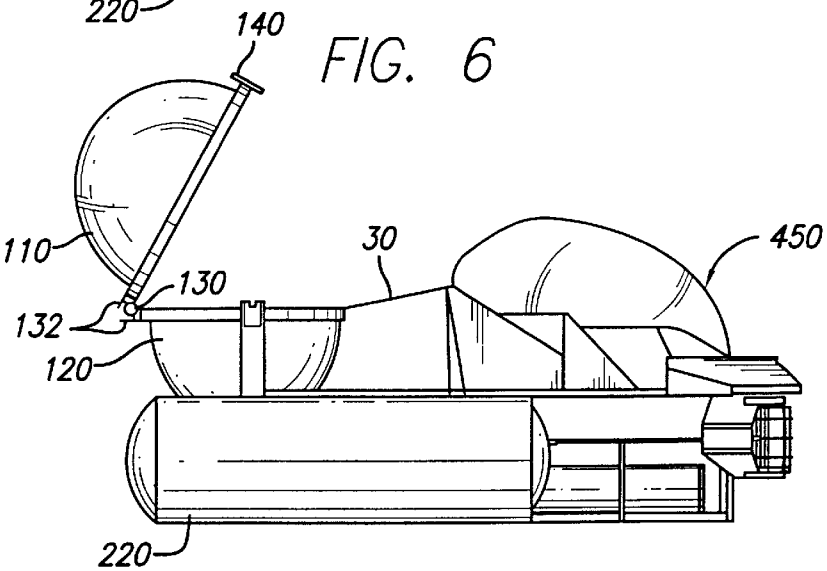
FIG. 7 is a side view of a watercraft having an open passenger chamber in accordance with the present invention.
Figure 5:
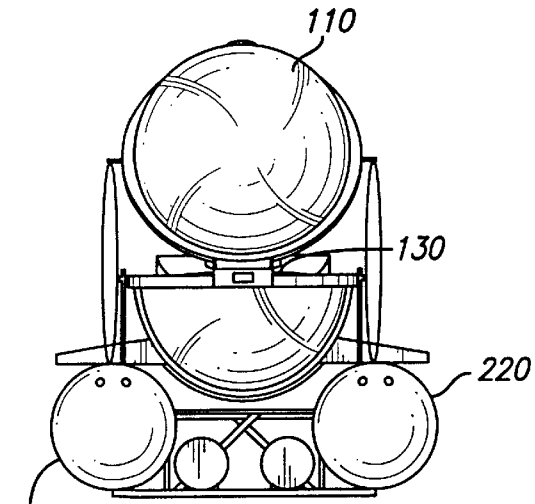
FIG. 5 is a front view of a watercraft having an open passenger chamber in accordance with the present invention.

It is also preferred that the hinge be situated at a side of the chamber 50, that is opposite from the other components of the underwater craft, providing a free path of rotation for the first section 110 as it swings from a closed to an open position and also minimizing the potential for damage of the first section 110 due to collision with other components of the underwater craft as it is opened. In the illustrated embodiment, the hinge 130 is at the forward end of the sphere, farthest away from the tail section 20 and at the forward most portion of the craft, in other words in the direction of forward travel of the underwater craft during operation. As illustrated in FIGS. 6 through 8, the first section 110 rotates about the hinge, generally upwards and away from the body of the underwater craft. It is also preferred a rotation limiting device be included to limit the amount of rotation of the first section 110 when it is opened to prevent it from colliding with any components at the forward side of the underwater craft as it is rotated into an open position. Any such limiter may be used. In the illustrated embodiment, hinge plates 132 are included in the hinge mechanism 130 limiting the degree of rotation of the hinge. Alternatively, a gas/spring limiter such as is known in the art may be used. In one such embodiment, the first section is limited to rotating 120° about the hinge 130 from its closed position.

The sealing system 60 also includes sealing mounting structures associated with each of the sections of the passenger chamber 50 (in the illustrated embodiments, these include the first and second sections 110, 120). In the illustrated embodiment, a first sealing surface structure 62 is associated with the first section 110. A structural component of the first section, such as a top portion of the illustrated spherical passenger chamber 50, i.e. top shell 112, is provided and assembled together with first sealing surface structure 62 in any way that securely attaches the top shell 112 with the first sealing surface structure 62. The first sealing surface structure 62 includes a receiving apparatus for receiving and securing the top shell 112. In one embodiment a recess into which the top shell 112 is received and an adhesive layer 170 is used to secure the two components together and also promote a water-tight seal therein. An optional sealing plate 63 also may be used to further secure the top shell 112 and first sealing surface structure 62 in relation to each other and another adhesive layer 172 also optionally is used to further secure the top shell 112 and the sealing plate 63. The sealing plate also optionally is secured to the first mounting structure by any means such as rivets, adhesive, screws or any other securing apparatus. In an alternate embodiment, the first section 110 is a unitary structure, with the components of the sealing system 60 associated with the first section 110 formed together with the first section 110.

Likewise a second portion of the sealing system 60, namely a sealing surface structure 64 is associated with the second section 120. A structural component of the second section, such as a bottom portion of the spherical passenger chamber 50, i.e. a bottom shell 122, is provided and assembled together with mounting structure 64 in any way that securely attaches the bottom shell with the sealing surface structure 64. Preferably, the sealing surface structure 64 includes a receiving apparatus for receiving and securing the bottom shell 122. In one embodiment a recess into which the bottom shell 122 is received and an adhesive layer 175 is used to secure the two components together and also promote a water-tight seal therein. An optional sealing plate 65 also may be used to further secure the bottom shell 122 and sealing surface structure 64 in relation to each other and another adhesive layer 177 also optionally is used to further secure the bottom shell 122 and the sealing plate 65. The sealing plate 65 also optionally is secured to the second mounting structure by any means such as rivets, adhesive, screws or any other securing apparatus. In an alternate embodiment, the second section 120 is a unitary structure, with the components of the sealing system 60 associated with the second section 120 formed together with the second section 120.

Both the first and second mounting structures 62, 64 are constructed of a material having sufficient structural strength to withstand the pressures received by the underwater craft, when under the surface of a body of water. Any material having sufficient strength may be selected. In a preferred embodiment, the material is aluminum or an aluminum alloy, although other materials also may be used such as stainless steel, titanium, other metals, plastics, rubbers, other polymeric materials, fiber composites and ceramics.

In the preferred embodiment, a double seal is used to seal the first and second sections 110, 120 of the passenger chamber 50 in a closed position so as to minimize fluid intrusion from the exterior of the chamber 50 into the interior. The double seal structure of the sealing system 60 includes a low pressure sealing system 150, 155 and a high pressure sealing system 160, 165 promoting sealing in low and high pressure environments.

The high pressure sealing system includes a receiving apparatus associated with either the first section 110 or the second section 120. In the illustrated embodiment, the receiving apparatus includes a high pressure receiving aperture 160 in the first sealing surface structure 62 associated with the first section 110. The aperture is illustrated in a cut-away view in FIG. 9 and in cross-section in FIG. 10. The high pressure receiving aperture 160 preferably is an annular groove extending fully around the first sealing surface structure 62. A high pressure fluid barrier or seal 155, such as an O-ring, is mounted in the high pressure receiving aperture 160. Any form of high pressure seal 155 may be used which can form a seal when contacted with a sealing surface 67 on the sealing surface structure 64. In a preferred embodiment, the high pressure seal is made of a resilient rubber or plastic annular ring. At high external pressures, the external pressure forces act to push the sealing surfaces 62, 64 and the first and second sections 110, 120 together, sealing the passenger chamber 50 from aquatic intrusion. At lower pressures, the resiliency of the high pressure seal 165 sufficiently resists the lower pressures, acting to push apart the sealing surfaces 62, 64, making the passenger chamber susceptible to aquatic intrusion. In a preferred embodiment, the pressures on the underwater craft are sufficiently high at depths exceeding twenty feet to compress the high pressure seal 165 sufficiently to form a water-tight seal for the passenger chamber 50, although other operational depths may also be selected.

The low pressure sealing system 150, 155 provides sealing against fluid intrusion at lower pressures. The low pressure sealing system includes a receiving apparatus for receiving a low pressure fluid barrier or sealing ring 155. In the illustrated embodiment, the receiving apparatus includes a receiving aperture 150 in the first sealing surface structure 62. The receiving aperture 150 preferably is an annular groove extending fully around the first sealing surface structure 62. A low pressure seal 155, is mounted in the receiving aperture 160. Any form of low pressure seal 155 may be used which can form a seal when contacted with a sealing surface 67 on the sealing surface structure 64. In a preferred embodiment, the low pressure seal is made of an annular ring that is more elastic than the high pressure seal 165, thereby forming a water tight seal at lower pressures. Preferably, the operation of the hinge 130 and latch 140 latching the passenger chamber 50 in a closed position with the first and second sections rotated to a mating position, operate to exert sufficient pressure for the low pressure seal to form a water-tight seal, preventing water intrusion. Also, it is preferred that the pressure exerted by the low pressure seal 155 has minimal effect on pushing the first and second sections 110, 120 apart. In other words, the pressure exerted by the low pressure seal does not exceed that exerted by the closing and latching of the chamber 50.

It is also preferred that there exist an overlap in the range of effectiveness of the low pressure sealing system 150, 155 and the high pressure sealing system 160, 165. For example, in the embodiment where the high pressure sealing system 160, 165 forms a water tight seal at depths exceeding twenty feet, it is preferred that the low pressure sealing system 150, 155 also provide a water tight seal at depths exceeding twenty feet, taking advantage of the external aquatic pressure on the passenger chamber 50 forcing the first and second sections together and compressing the sealing ring 165. In one example, the low pressure sealing system provides an effective seal at pressures expected from zero to thirty feet. It should be understood that other ranges of effectiveness for the low pressure and high pressure seals may be selected, so long as effective sealing is achieved at various operational depths of the underwater craft.

In other embodiments, multiple seals are used, having varying ranges of effectiveness. For example, three annular seals are used in one embodiment, in which the first annular seal is effective at depths from zero to twenty feet, the second annular seal is effective at depths from fifteen to fifty feet and the third annular seal is effective at depths exceeding forty feet.

It is also preferred that the seals be arranged from the highest pressure seal being closest to the interior of the passenger chamber 50 and the lowest pressure seal being closest to the exterior of the passenger chamber 50.

Additional buoyancy of the underwater craft also can be provided using a surface-buoyancy supplementing system. In the surface buoyancy supplementing system, buoyancy chambers 40 are used. Either hard or soft buoyancy chambers may be used. Hard buoyancy chambers provide buoyant force when flushed of water, leaving an evacuated chamber, such as filled with unpressurized air, but having sufficient structural rigidity to provide buoyancy. When less buoyancy is desired, the hard chambers are allowed to fill with water, creating a generally neutral buoyancy. The chambers 40 may be used to provide buoyancy, preferably when the underwater craft is on the surface of the water. Preferably, when submerged, water is allowed to flow into hard chambers 40, creating a neutral buoyancy.

In the preferred embodiment, the supplemental buoyancy chambers 40 are "soft" chambers. A resilient inflation bladder 210 is provided within a mounting structure 220. A cylindrical mounting structure 220 is illustrated, but any suitable shape may be used so long as the inflation bladder 210 can be mounted to the support structure 10 of the underwater craft. Any water tight material can be used, such as a rubber or plastic or other polymer. To provide buoyancy, the soft chambers are filled with a fluid having a lower density than water. Any gas or fluid may be used, although it is preferred that the fluid be air such as can be provided by standard scuba air tanks 225. To decrease buoyancy, the air is evacuated from bladder 210. Any exhaust apparatus 230 for evacuating the bladder 210 may be used, including an active system such as a pump or a passive system such as a valve 215. Preferably, a passive system is used and when opened, ambient pressure on the external surfaces of the bladder 210 operate to collapse the bladder 210, forcing out any inflation fluid contained therein. To prevent water intrusion into the bladder 210, it is preferred that a one-way valve 215 be used in the exhaust system 230. The exhaust system may have single or multiple ports 240. The ports are connected with the interior of the bladder 210 using piping 235. The piping 235 may connect to any location on the bladder 210, including for example, the bottom, side, front, rear or top. Likewise, the ports 240 can be at any location on the shell 220, although it is preferred that the ports 240 be generally situated above the bladder 210, promoting passive evacuation, i.e. using water pressure alone to force the inflation fluid out of the bladder 210.

In operation, when the bladder 210 is fully inflated it occupies a volume providing buoyant force. It is preferred that the bladder 210 assume a streamlined shape when inflated so as to reduce drag, but any shape may be used. When the bladder 210 is deflated, it collapses under the force of ambient water pressure. In the preferred embodiment one or more standard scuba air tanks 225 and associated pressure regulators are used to provide a source of inflation fluid, namely pressurized air. A valve 250 is opened in order to force air into the bladder 210. The air travels through tubing 245 to the interior of the bladder 210, inflating the bladder 210 by overcoming the ambient aquatic pressure.

The underwater craft is controlled from within the passenger chamber 50. These controls include mechanisms for adjusting the depth of the craft, such as by controlling the buoyancy provided by the supplemental buoyancy system 40. Other controls include for example, steering, internal atmosphere and speed of travel controls. Optionally, the controls can be located outside the passenger chamber 50, for external control, such as by a guide accompanying the craft. Preferably, controls are provided within the passenger chamber 50, for control by passengers, as well as externally, for use in emergencies or for use by a diver or guide accompanying the underwater craft. External controls are particularly useful for training purposes or for providing tours to passengers who have no prior experience.

An external control station 400 is provided outside the passenger chamber 50. Preferably the external control station 400 is located behind the passenger chamber 50, as illustrated in the figures, although it can be located at any position on the watercraft providing access to a person for operating external controls. It is also preferred that the external control station 400 be located behind the passenger chamber 50 promoting ease of viewing the passengers for the person operating the external controls, to promote viewing of the path of forward travel and to allow the external operator to override the actions of the passengers controls if desired or necessary. A communications system 410 also is provided for allowing the external controller to communicate with the interior of the passenger chamber 50, such as for touring information or training instruction. This communication system may include any form of electronic or mechanical system that can transmit sounds or electronic information. For example, the communications system may include a computer input device, such as a keyboard, and a display or the communications system may include an intercom. External controls 420 are provided for operation of the watercraft, including controls for direction of travel, velocity, depth and/or braking.

The external control station 400 also preferably provides ergonomic accommodations for an external operator. In the illustrated embodiment, knee and foot rests 430, and a seat 440 are provided for the external operator to ride motorcycle style or resting on the operator's front torso. Alternatively, a seat or other accommodation may be provided.

In one embodiment, illustrated in FIG. 7, the external control station 400 includes a covering 450 creating a chamber accommodating one or more people. The covering 450 optionally may form a sealed chamber with breathable air provided for the person occupying the chamber. Likewise, the covering may be made of any suitable material, preferably being entirely or at least partially clear providing the occupant an external view. This is particularly useful if the external occupant is steering or otherwise controlling the travel of the underwater craft.

It is also preferred that the external operator or occupant be connected to an emergency safety switch 460, so that if the operator or occupant leaves the external control station, whether voluntarily or involuntarily, the switch 460 operates to stops the craft. For example, operation of the emergency safety switch 460 can power down the vertical thruster 30. In the preferred embodiment in which the underwater craft has a positive buoyancy countered by the vertical thruster 30, the underwater craft rises towards the surface when the vertical thruster 30 is stopped. Likewise, if ballast is used, operation of the emergency switch can cause the ballast to be jettisoned also promoting movement of the craft towards the surface. In one embodiment, the external operator or occupant is tethered to the emergency safety switch and the switch is operated when the tether is pulled.

EXAMPLE

An underwater craft was constructed with a frame section 510 is provided as part of the structure 10 supporting various components. The tail section 20 was connected with the frame section 510. The external operator station 400 also was connected with the frame section 510. The knee and foot rests 430 and seating structure 440 were constructed of molded fiberglass, although it is noted that any material and manufacturing process can be used. A vertical thruster 30 was provided, mounted between a generally spherical passenger chamber 50 and the operator station 400. The spherical passenger chamber 50 was split into two halves, a lower half 120 fixedly mounted to the support structure 10 and an upper canopy 110 hingedly mounted using a hinge 130 to the lower half 120. The hinge 130 was situated at the fore portion of the passenger chamber 50 and a latch 140 was provided at the aft portion, approximately 180° around the center circumference of the sphere from the hinge 130. A dual seal also was provided having a lower pressure outer seal 165 and a higher pressure inner seal 155. Two cylindrical buoyancy chambers 40 were mounted generally beneath and to the side of the passenger chamber 50, in a pontoon-like fashion.

The above-described features of the present invention can be combined together in any fashion. For example, one embodiment of the invention has a portion of the above-described features. Another embodiment incorporates each of the features in a single underwater craft.

Exemplary embodiments include an underwater craft having a sealed passenger chamber providing buoyancy, having a low pressure and high pressure sealing system; an underwater craft having a sealed passenger chamber providing buoyancy, having a low pressure and high pressure sealing system and an external operator station; and an underwater craft having a sealed passenger chamber providing buoyancy, having a low pressure and high pressure sealing system and a supplemental buoyancy system having soft inflation bladders.

Thus, it is seen that an underwater watercraft is provided. One skilled in the art will appreciate that the present invention can be practiced by other than the preferred embodiments and alternate embodiment, all of which are presented for purposes of illustration and not of limitation, and the present invention is limited only by the claims which follow. It is noted that equivalents of the particular embodiments discussed in this description may practice the invention as well.

What is claimed is:

1. A sealable chamber comprising:

an interior;

an exterior;

a first section having a first end surface;

a second section having a second end surface, said first end surface adapted to engage said second end surface;

a plurality of substantially concentrically arranged fluid barriers graduated to seal at different depth ranges, positioned between said first end surface and said second end surface, including a first fluid barrier rated for a first depth range and a second fluid barrier rated for a lower depth range than the first fluid barrier.

2. A sealable chamber comprising:

an interior;

an exterior;

a first section having a first end surface;

a second section having a second end surface, said first end surface adapted to engage said second end surface; and a plurality of substantially concentrically arranged fluid barriers graduated to seal at different depth ranges, positioned between said first end surface and said second end surface, including a first fluid barrier rated for a first depth range and a second fluid barrier rated for a lower depth range than the first fluid barrier wherein said plurality of fluid barriers is graduated such that the depth range of any fluid barrier relates to any adjacent fluid barrier closer the exterior such that their respective depth ranges overlap and the fluid barrier closer to the exterior resists pressures at a shallower depth underwater, and any fluid barrier relates to any adjacent fluid barrier closer to the interior such that their respective depth ranges overlap and the fluid barrier closer to the interior resists pressures at a deeper depth underwater.

3. A sealable chamber comprising:

an interior;

an exterior;

a first section having a first end surface;

a second section having a second end surface, said first end surface adapted to engage said second end surface; and a plurality of substantially concentrically arranged fluid barriers graduated to seal at different depth ranges, positioned between said first end surface and said second end surface, including a first fluid barrier rated for a first depth range and a second fluid barrier rated for a lower depth range than the first fluid barrier wherein said plurality of fluid barriers comprises a low pressure fluid barrier, a high pressure fluid barrier, and at least one intermediate pressure fluid barrier, wherein said plurality of fluid barriers is ordered such that said low pressure fluid barrier is closer to the exterior of said chamber and said high pressure fluid barrier is closer to the interior of said chamber and said at least one intermediate fluid barrier is positioned between said low pressure fluid barrier and said high pressure fluid barrier.

4. A sealable chamber as in claim 2 or 3 wherein said first end surface includes a plurality of grooves adapted to engage said plurality of fluid barriers.

5. A sealable chamber as in claim 2 or 3 wherein said sealable chamber is substantially spherical.

6. A sealable chamber as in claim 2 or 3 further comprising:

a hinge rotabably connecting said first section and said second section, between an open position and a closed position; and a latch mechanism spatially separated from said hinge member and releasably connecting said first section and said second section to secure said sealable chamber in said closed position.

7. A sealable chamber as in claim 6 wherein said hinge mechanism further comprises a rotation limiting device.

8. A sealable chamber comprising:

a first section having a first end surface;

a second section having a second end surface, said first end surface adapted to engage said second end surface;

a plurality of eccentrically arranged fluid barriers graduated to seal at different pressures, positioned between said first end surface and said second end surface, including a first fluid barrier rated for a first depth range and a second fluid barrier rated for a lower depth range than the first fluid barrier.

9. A sealable chamber comprising:

a first section having a first end surface;

a second section having a second end surface, said first end surface adapted to engage said second end surface; and a plurality of eccentrically arranged fluid barriers graduated to seal at different pressures, positioned between said first end surface and said second end surface, including a first fluid barrier rated for a first depth range and a second fluid barrier rated for a lower depth range than the first fluid barrier;

wherein said plurality of fluid barriers is graduated such that the depth range of any fluid barrier relates to any adjacent fluid barrier closer the exterior such that their respective depth ranges overlap and the depth range of the fluid barrier closer to the exterior extends to a shallower depth, and any fluid barrier relates to any adjacent fluid barrier closer to the interior such that their respective depth ranges overlap and the depth range of the fluid barrier closer to the interior extends to a deeper depth.

10. An underwater craft comprising:

a support structure;

a sealable chamber having an interior and mounted on said support structure;

a first operator station within said sealable chamber interior;

a second operator station outside said sealable chamber interior; and a buoyancy system;

said sealable chamber having a plurality of fluid barriers concentrically positioned and rated for different overlapping pressure levels with those fluid barriers having lower pressure level ratings positioned closer to said chamber exterior.

11. An underwater craft as in claim 10 further comprising a communications system connected between said first operator station and said second operator station.

12. An underwater craft as in claim 10 wherein said buoyancy system comprises:

a mounting structure affixed to said support structure;

a resilient deformable bladder having an interior and an exterior mounted to said mounting structure;

a source of inflation fluid connected via a conduit to said bladder interior; and an exhaust port mounted from said bladder interior to said bladder exterior.

13. An underwater craft comprising:

a support structure;

a chamber mounted on said support structure and having an interior;

a first operator station located in said chamber interior; and a second operator station mounted on said support structure;

further comprising a communication system linked between the first operator station and the second operator station; and wherein the first and second operator stations include navigational controls.

14. An underwater craft comprising:

a support structure;

a chamber mounted on said support structure and having an interior;

a first operator station located in said chamber interior; and a second operator station mounted on said support structure;

wherein the support structure further comprises a front end and a back end and the chamber is positioned at said front end and the second operator station is positioned between the chamber and said back end.

15. An underwater craft comprising:

a support structure;

a chamber mounted on said support structure and having an interior;

a first operator station located in said chamber interior; and a second operator station mounted on said support structure;

wherein said second operator station further comprises an emergency safety switch that will stop the craft should the operator leave said second operator station.

16. An underwater craft comprising:

a support structure;

a chamber mounted on said support structure and having an interior;

a first operator station located in said chamber interior; and a second operator station mounted on said support structure wherein said second operator station is encased within a fluid impermeable chamber mounted on said support structure.

17. A buoyancy system for an underwater craft, the buoyancy system comprising:

a mounting structure;

a resilient deformable bladder having an exterior and an interior;

a source of inflation fluid;

a conduit; and at least one exhaust port;

said resilient deformable bladder attached to said mounting structure and said bladder interior connected to said source of inflation fluid via said conduit, and said at least one exhaust port mounted from the bladder interior to said bladder exterior; wherein the underwater craft can operate when submerged without ballast water.

18. The buoyancy system of claim 17, wherein the mounting structure is a cylindrical shell surrounding the resilient deformable bladder.

19. The buoyancy system of claim 17, wherein the source of inflation fluid is a pressurized tank of inflation fluid, and further comprises at least one valve between said pressurized tank of inflation fluid and the bladder interior.

20. The buoyancy system of claim 17, wherein said buoyancy system has a reduced cross-sectional area for underwater operation.

21. The buoyancy system of claim 17, wherein said buoyancy system provides stability and buoyancy for loading and unloading passengers.

* * * * *